US007757907B2

(12) United States Patent
Smith et al.

(10) Patent No.: US 7,757,907 B2
(45) Date of Patent: Jul. 20, 2010

(54) SPOUT FOR ENSURING EVACUATION OF A FLEXIBLE CONTAINER

(75) Inventors: Mark A. Smith, Plainfield, IL (US); Daniel Petriekis, Worth, IL (US)

(73) Assignee: DS Smith Plastics Limited, Maidenhead, Berkshire (GB)

( * ) Notice: Subject to any disclaimer, the term of this patent is extended or adjusted under 35 U.S.C. 154(b) by 170 days.

(21) Appl. No.: 11/482,622

(22) Filed: Jul. 7, 2006

(65) Prior Publication Data

US 2008/0006655 A1 Jan. 10, 2008

(51) Int. Cl.
*B65D 35/00* (2006.01)
*B67D 3/00* (2006.01)

(52) U.S. Cl. ..... 222/564; 222/92; 222/189.07; 222/212; 222/573; 222/494; 383/906

(58) Field of Classification Search ..... 222/92, 222/107, 212, 213, 564, 566, 494, 573, 517, 222/96, 189.05, 189.06, 189.07; 383/906
See application file for complete search history.

(56) References Cited

U.S. PATENT DOCUMENTS

| | | | | | |
|---|---|---|---|---|---|
| 1,241,511 | A * | 10/1917 | Hansen | 222/189.01 |
| 1,339,008 | A * | 5/1920 | Strong | 222/189.07 |
| 2,753,051 | A * | 7/1956 | Tupper | 210/239 |
| 3,674,183 | A * | 7/1972 | Venable et al. | 222/212 |
| 5,409,144 | A * | 4/1995 | Brown | 222/185.1 |
| 6,230,940 | B1 * | 5/2001 | Manning et al. | 222/185.1 |
| 2007/0053617 | A1 * | 3/2007 | Naidu et al. | 383/66 |

* cited by examiner

*Primary Examiner*—J. Casimer Jacyna
(74) *Attorney, Agent, or Firm*—Rockey, Depke & Lyons, LLC

(57) ABSTRACT

The present invention is directed to a spout having an evacuation structure for a flexible container. The evacuation structure ensures that the walls of the flexible container do not block the spout of the container during evacuation of fluid from inside the container. The evacuation structure additionally pivots away from the spout during the filling of the container so that the evacuation structure does not impede the fluid entering the container during filling.

7 Claims, 1 Drawing Sheet

SPOUT FOR ENSURING EVACUATION OF A FLEXIBLE CONTAINER

BACKGROUND OF THE INVENTION

This invention relates to flexible containers, and more particularly to evacuation structures for such containers. Flexible polymeric containers are well known for storing and dispensing wine, dairy products, enteral feeding solutions, fruit juices, tea and coffee concentrates, puddings, cheese sauces, and many other flowable materials, including those that must be filled aseptically. These generally include low acid materials. Flexible polymeric containers typically have walls made of polymeric films with either a monolayer or multiple layer structure. The particular polymers constituting the container film layers vary depending on the type of material to be placed in the container. The film layers may also include an oxygen barrier material layer to prevent contact between such materials and oxygen or other gas sensitive contents. The walls of the flexible containers may be metallized, or coated with a metallic layer such as aluminum to prevent incursion of oxygen or other gases. A separate metallized enclosure may also encase the polymeric container.

The flexible polymeric containers have inlets and/or spouts for filling and dispensing the flexible container contents. The flexible containers are also often placed within a box. The spout extends through an opening in the box to dispense the contents. Such packaging systems are commonly referred to as "bag-in-box." Bag-in-box packaging systems are often used in restaurants and convenience stores to facilitate service of liquid food products such as syrups, toppings, and condiments.

After the flexible container is filled with a desired material, the spout is capped to seal the flexible container and protect the contents from contamination. Depending on the type of contents, the container, spout, cap, and contents may be heat sterilized using steam, an autoclave process, or similar method.

To access and dispense the contents of the flexible container, the flexible container must be evacuated, generally using a vacuum or suction process. Initially all of the air within the flexible container is evacuated. Subsequently, the fluid in the bag is evacuated.

Problems can arise during the evacuation of the fluid. Often times, due to the suction force on the flexible container, the walls of the flexible container become lodged in the spout. This blocks up the spout and cuts off the passageway for the fluid. Thus, the evacuation process is essentially stopped, rendering the fluid inaccessible.

For these reasons, an evacuation structure for use with a flexible container that both minimizes obstruction of the spout and maximizes the amount of fluid evacuated is desired.

Prior art devices have attached various mechanisms directly to the spout in an attempt to solve the above-described problem. Several issues have been encountered with these kind of devices. For example, during the filling process of the flexible containers, which is typically done in a high speed and high pressure process, the prior art devices are susceptible of being dislodged from the spout rendering the devices inoperative. Moreover, the prior art devices can impede the flow of liquid during the filling process thereby slowing down the filling process Thus, not only is an evacuation device that both minimizes obstruction of the spout and maximizes the amount of fluid evacuated desired, but the evacuation device must also not impede the filling process of the flexible containers.

SUMMARY OF THE INVENTION

The present invention provides an evacuation structure for a flexible container including a spout in fluid communication with the flexible container, the spout having a base, a passageway, and an evacuation structure. The present invention provides a more efficient way of evacuating fluid from the flexible container. The evacuation structure ensures that the walls of the flexible container will not block the spout and inhibit the fluid evacuation.

In one embodiment of the present invention, the evacuation structure comprises at least one crosshair. The crosshair has two ends, and at least one end of at least one crosshair is pivotally or flexibly connected to the spout. During the filling process, the flexible connection allows fluid entering the container to pivot or flex the evacuation structure away from the spout so that the evacuation structure does not inhibit the filling of the flexible container. The fluid entering the container will physically flex the evacuation structure away from the spout.

None of the prior art devices described above provided an evacuation structure that pivots or flexes away from the spout during the filling process to allow for an unobstructed passageway for the fluid entering the container. The prior art devices all stay in the same position over the bottom end of the passageway throughout the entire filling process. None of the prior art devices pivots or flexes away from the spout during filling.

The evacuation structure of the present invention will also pivot or flex back towards the spout after filling. The evacuation structure can pivot back to the spout in a number of ways. One way is for the pivotal connection to have enough structural memory so that during the time after filling and before the flexible container is evacuated, the pivotal connection will return to its original position. Because the flexible containers are generally not evacuated for days and sometimes weeks after filling, the pivotal connection will have enough time to slowly return the evacuation structure to its original position.

Another way for the evacuation structure to pivot back into place to ensure that the container walls do not block the spout is for the structure to be pivoted back to the spout by the exiting liquid. During evacuation, the fluid in the container moves towards the spout. Thus, the flow of the fluid towards the spout, as well as the vacuum being exerted at the spout, will pivot the evacuation structure towards the spout. Thus, the evacuation structure will be in place to prevent the walls of the flexible container from entering the spout during evacuation.

It should be appreciated that the evacuation structure can be returned to or near the spout by a combination of the structural memory of the pivotal connection and the force exerted by the exiting fluid and vacuum.

It should also be appreciated that the evacuation structure does not have to be returned to its original position to ensure that the walls of the flexible container do not block the spout and inhibit the fluid evacuation. Rather, the evacuation structure can be adjacent to the spout during evacuation and still perform this function.

Additional features and advantages of the present invention are described in, and will be apparent from, the following Detailed Description of the Invention and the Figures.

DETAILED DESCRIPTION

Figure 1:
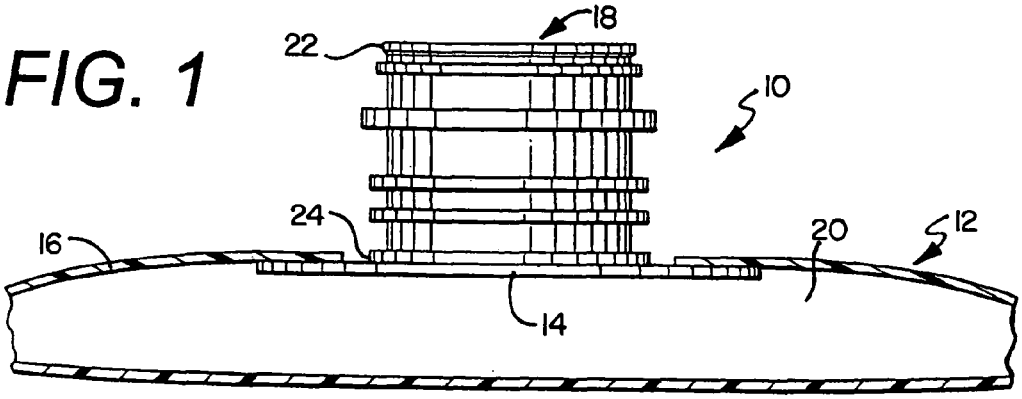
FIG. 1 is a schematic view of a spout and a container of the present invention.

While this invention is susceptible of embodiment in many different forms, there are shown in the drawings, and will herein be described in detail, preferred embodiments of the invention with the understanding that the present disclosure is to be considered as an exemplification of the principles of the invention and is not intended to limit the broad aspect of the invention to the embodiments illustrated.

Figure 2:
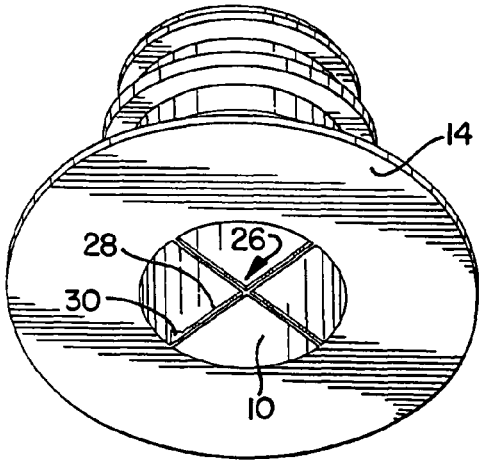
FIG. 2 is a bottom perspective view of an evacuation structure according to one embodiment of the present invention.

FIG. 1 shows a spout 10 in fluid communication with a flexible container 12 of the present invention. The spout 10 comprises a base 14, a passageway 18, and an evacuation structure 26. The base 14 is connected to one of a plurality of walls 16 of the flexible container 12. The spout 10 is generally centrally disposed on the base 14, the spout 10 extending in a perpendicular direction from the base 14. The passageway 18 within the spout 10 allows for fluid communication with the inside of the flexible container 20. The passageway 18 has a top end 22 and a bottom end 24. The passageway 18 is substantially perpendicular to the base 14. The evacuation structure 26 is connected to the bottom end 24 of the passageway 18 by a pivotal or flexible connection 30. The evacuation structure 26 as shown in FIG. 2 is substantially parallel to the base 14 of the spout 10.

Initially, the flexible container 12 is filled with fluid through the spout 10. The pivotal connection 30 of the evacuation structure 26 allows it to flex away from the spout 10 when the flexible container 12 is filled with fluid. This is shown by the direction of arrow A in FIG. 3. Thus, the pivoting of the evacuation structure 26 ensures the evacuation structure 26 will not obstruct the flow of the fluid, inhibiting the filling of the flexible container 12. In addition, because the evacuation structure 26 is flexibly movable, it will not break off under the force of the fluid during filling.

During evacuation of the fluid, the evacuation structure 26 will pivot back towards the spout 10, ensuring that the walls 16 of the flexible container 12 will not inhibit the fluid from evacuating. The flow of the evacuating fluid will cause the evacuation structure 26 to return to its original position or close enough to the spout 10 so the evacuation structure 26 will prohibit the walls 16 of the flexible container 12 from blocking the spout 10 during evacuation.

Alternatively, in another embodiment of the present invention, the pivotal connection 30 will have memory. After filling and before evacuation of the flexible container 12, the memory of the pivotal connection 30 will cause the evacuation structure 26 to pivot back towards the spout 10.

The evacuation structure 26 will prohibit the walls 16 of the flexible container 12 from entering the passageway 18 when the flexible container 12 is evacuated. The evacuation structure 26 ensures that the fluid is not blocked from entering the spout 10 during evacuation by the walls 16 of the flexible container 12.

Figure 3:
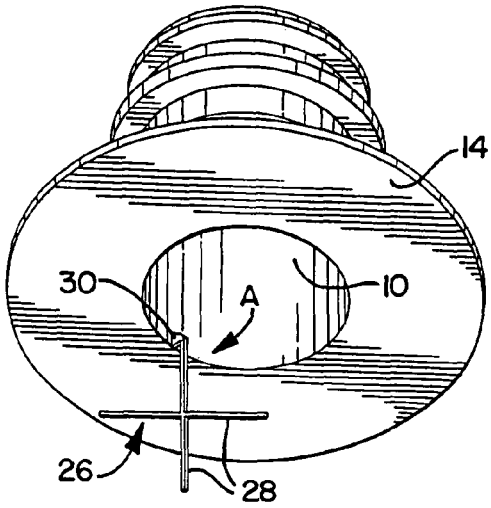
FIG. 3 is a bottom perspective view of an evacuation structure according to one embodiment of the present invention.

As shown in FIGS. 2 and 3, in one embodiment of the present invention, the evacuation structure 26 comprises at least one crosshair 28. At least one end of one crosshair 28 is pivotally connected 30 to the bottom end 24 of the passageway 18.

In another embodiment of the present invention, the evacuation structure 26 comprises at least two crosshairs 28. The crosshairs 28 overlapping one another so that both can be pivoted away from the spout 10.

The crosshairs 28 could have a circular cross-sectional area, a rectangular cross-sectional area, or a variety of other shapes. The crosshairs 28 extend across the bottom of the passageway 24 so that each end of the crosshairs 28 is proximate the spout 10.

As shown in FIGS. 2 and 3, in one preferred embodiment of the present invention, the evacuation structure 26 comprises two members 28 which are substantially perpendicular to each other and are connected at the point where they overlap. One end of one member 28 is pivotally connected 30 to the bottom end 24 of the passageway 18 of the spout 10.

Figure 4:
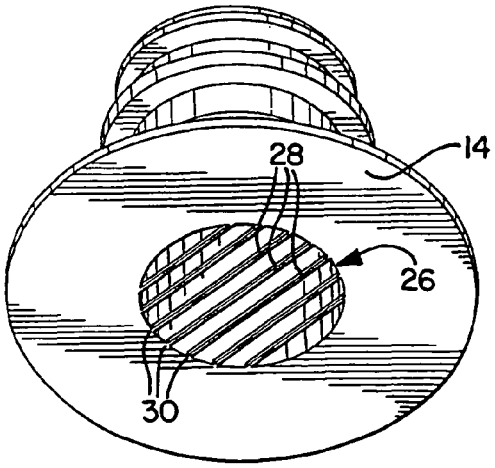
FIG. 4 is a bottom perspective view of an evacuation structure according to another embodiment of the present invention.

As shown in FIG. 4, in another embodiment of the present invention, the evacuation structure 26 comprises at least two members 28. The members 28 are substantially parallel to one another. The parallel members 28 can have substantially the same length as one another, or the members 28 can have varying lengths.

Figure 5:
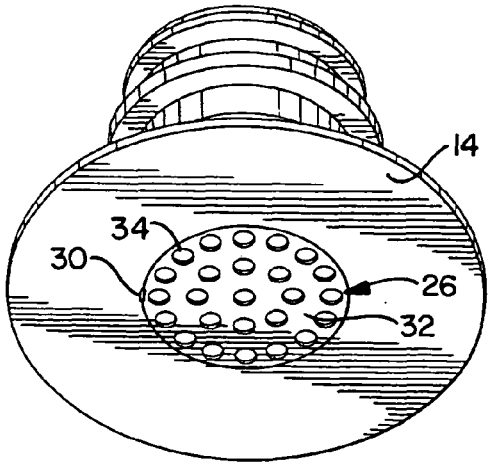
FIG. 5 is a bottom perspective view of an evacuation structure according to another embodiment of the present invention.

As shown in FIG. 5, in another embodiment of the present invention, the evacuation structure 26 is a substantially flat permeable plate 32. The permeable plate 32 has a periphery 34, and at least one point on the periphery 34 is pivotally connected 30 to the bottom end 24 of the passageway 18 of the spout 10. It should be understood that the permeable plate 32 could have a concave or convex shape to it.

It should be appreciated that a number of other embodiments of the present invention would perform the same functions of the present invention. The present invention provides an evacuation structure 26 that will prohibit the walls 16 of the flexible container 12 from entering the passageway 18 during evacuation, thereby inhibiting the fluid evacuation. The present invention also provides an evacuation structure 26 which will not impede the filling of the flexible containers 12.

While the specific embodiments have been illustrated and described, numerous modifications come to mind without significantly departing from the spirit of the invention and the scope of protection is only limited by the scope of the accompanying Claims.

The invention claimed is:

1. A spout connected in fluid communication to a flexible container, the spout comprising:

a base being connected to one of a plurality of walls of the flexible container, wherein the spout is generally centrally disposed on a base, and the spout extends in a perpendicular direction from the base;

a passageway having a diameter within the spout in fluid communication with an inside of the flexible container, the passageway having a top end and a bottom end, the passageway being substantially perpendicular to the base; and, an evacuation structure having fluid channels therethrough pivotally connected to the bottom end of the passageway and moveable from a fill position to an evacuate position, the structure being substantially parallel to the base and spanning the entire diameter of the passageway in the evacuate position, the entire evacuation structure pivoting in a same direction away from the spout to the fill position when the flexible container is filled through the spout with fluid and does not span the entire diameter of the passageway, wherein the pivotal connection has a memory such that after filing, the memory causes the structure to pivot back towards the spout ensuring that the walls of the flexible container do not prohibit the fluid from evacuating.

2. The spout of claim 1, wherein the evacuation structure prohibits the walls of the flexible container from entering the passageway when the flexible container is evacuated.

3. The spout of claim 1, wherein the evacuation structure comprises at least one crosshair structure, the crosshair having two overlapping structural members and at least one end of one member is pivotally connected to the bottom end of the passageway.

4. The spout of claim 3 wherein the overlapping structural members are attached at a point at which they overlap with one another.

5. The spout of claim 1, wherein the evacuation structure is a substantially flat permeable plate, the permeable plate having a periphery, at least one point on the periphery being pivotally connected to the bottom end of the passageway.

6. A spout connected in fluid communication to a flexible container, the spout comprising:

a base being connected to the flexible container, wherein the spout is generally centrally disposed on the base, and the spout extends in a perpendicular direction from the base;

a passageway having a diameter allowing for fluid communication with the flexible container, the passageway having a top end and a bottom end, the passageway being substantially perpendicular to the base;

an evacuation assistance structure pivotally connected to the bottom end of the passageway generally parallel to the base and spanning the entire diameter when in an dispensing position, the evacuation structure pivoting away from the spout to a fill position where the structure does not span the entire diameter when the flexible container is filled through the spout with fluid, the pivotal connection having a memory such that after filling, the memory causes the evacuation structure to pivot back towards the spout after filling; and, wherein the evacuation assistance structure has a liquid flow through hole region formed therein such that, even when the evacuation assistance structure is pivoted all the way back towards the spout to a closed position, liquid is allowed to flow through the evacuation assistance structure and into the passageway.

7. The spout of claim 6, wherein the evacuation structure prohibits the walls of the flexible container from entering the passageway when the flexible container is evacuated.

* * * * *